US005240070A

United States Patent [19]

Ryan

[11] Patent Number: 5,240,070

[45] Date of Patent: Aug. 31, 1993

[54] ENHANCED SERRATED FIN FOR FINNED TUBE

[75] Inventor: Jerry E. Ryan, Tulsa, Okla.

[73] Assignee: Fintube Limited Partnership, Tulsa, Okla.

[21] Appl. No.: 927,015

[22] Filed: Aug. 10, 1992

[51] Int. Cl.[5] ..... F28F 1/36

[52] U.S. Cl. ..... 165/184; 165/181

[58] Field of Search ..... 165/181, 184

[56] References Cited

U.S. PATENT DOCUMENTS

| | | | |
|---|---|---|---|
| 3,183,970 | 5/1965 | Worley | 165/181 |
| 3,207,673 | 9/1965 | Bowden | 176/181 |
| 4,227,572 | 10/1980 | Harlan | 165/184 |
| 4,258,782 | 3/1981 | Kao | 165/109 T |
| 4,538,677 | 9/1985 | Bódás et al. | 165/146 |
| 4,648,441 | 3/1987 | van de Sluys et al. | 165/111 |
| 5,046,556 | 9/1991 | Andersson | 165/181 |

FOREIGN PATENT DOCUMENTS

| | | | |
|---|---|---|---|
| 169478 | 1/1986 | European Pat. Off. | 165/184 |
| 56-130598 | 10/1981 | Japan | 165/184 |
| 61-1995 | 1/1986 | Japan | 165/184 |
| 235639 | 12/1944 | Switzerland | 165/184 |
| 507767 | 4/1976 | U.S.S.R. | 165/184 |
| 9062829 | 9/1962 | United Kingdom | 165/184 |

*Primary Examiner*—Allen J. Flanigan

*Attorney, Agent, or Firm*—William S. Dorman

[57] ABSTRACT

The present invention is an enhanced type of fin for making an enhanced serrated finned tube for use in heat exchange applications. The segments, which are formed on the fin when the fin is serrated, are enhanced either prior to serration or after serration. The enhancement consists of impressing, cutting or otherwise providing indentations into the segments, thus broadening the segments, increasing their surface area, and increasing their heat transfer capability.

14 Claims, 6 Drawing Sheets

ENHANCED SERRATED FIN FOR FINNED TUBE

BACKGROUND OF THE INVENTION

1. Field of the Invention

The present invention is an enhanced type of fin for a serrated finned tube. The enhancement consists of increasing the fin's heat transfer capability by increasing the surface area of the segments provided on the fin. Enhancement may be performed either prior to or after serration of the fin into segments. The enhancement of the present invention may be accomplished either by impressing, cutting, flattening, rolling or otherwise providing indentations into the segments, thus broadening the segments and increasing their surface area.

2. The Prior Art

Finned tubes are employed in a process heater or boiler. Finned tubes are used because the fins on the tubes increase the exterior surface area of the tubes and thus increase their heat transfer capability. The function of the finned tubes is to transfer heat from hot flue gases located outside the finned tubes to a liquid, generally high purity water or a hydrocarbon, circulating inside the finned tubes. The heated liquid is used to operate a turbine or used for other process purposes.

Because of the high cost of fuel required to heat the liquid, it is important that transfer of thermal energy, i.e. heat, through the finned tube be as efficient as possible so the amount of fuel can be reduced. When the number of BTU's of fuel needed to heat the liquid is reduced, operating costs are significantly reduced, also. For these reasons finned tubes having large exterior surface areas are desirable.

The exterior surface areas of prior art finned tubes have been increased by at least two means, spacing the fins closer together and providing higher fins.

First, the fins of prior art finned tubes are attached to a pipe helically with adjacent helical spirals of the fins spaced apart. By spacing the fins closer together, more fins, and thus more surface area, can be attached to the tube per unit surface area of the tube, thus increasing the effective surface area of the tube.

However, if adjacent spirals of fins are spaced too closely together, space between adjacent fin spirals can plug up or become fouled. Fouling is dependent on the type of fuel which is burned. The resulting inadequate flow of flue gas between the fin spirals decreases their ability to absorb thermal energy from the flue gas. Also, if spaced still closer together, adjacent fins touch each other, thus decreasing their effective surface area with a resulting decrease in heat absorption efficiency. Providing adequate spacing between the spirals of prior art finned tubes thus limits the amount of exterior surface area attainable on a finned tube solely by means of spacing the fins closer together.

Second, the fins of prior art finned tubes are increased in height so that they extend outward further away from the tube, thus increasing the fin height and increasing surface area of the finned tubes. Increasing the fin height is more costly due to the additional material needed to produce the higher fin and due to the additional costs associated with transporting a larger and heavier finned tube or in transporting a larger and heavier heat exchanger produced from the larger finned tubes. Space constraints associated with the applications where the finned tubes will be employed often dictate the maximum allowable fin height, thus precluding an increase in fin height.

Higher fin segments are also weaker structurally, and they present more adverse conditions for interfin gas penetration. Also, the incremental surface generated by increasing the fin height is less and less effective, as compared to base tube surface and, therefore, is less cost effective because the lower fin efficiencies tend to negate some of the surface area gain. With lower fin efficiencies comes an increase in fin tip operating temperatures requiring the fin to be produced from more costly, higher heat resistant materials.

The present invention provides a cost effective way to increase the surface area of a serrated fin without spacing the fins closer together and without increasing the fin height. The present invention increases the surface area of segments of a serrated fin, either prior to or after serration, by causing the segments to be broadened, thus filling in a portion of each of the gaps which are formed between the segments in the normal process of serrating and forming the fins helically around the tube. The segments are broadened by impressing, cutting, flattening, rolling or otherwise providing an indentation, multiple indentations, or a pattern of indentations onto either part or all of the segment's surfaces.

SUMMARY OF THE INVENTION

The present invention is an enhanced fin for attachment to a hollow tube to create an enhanced serrated finned tube. The fin is attached to the tube within 15 degrees of perpendicular and is wrapped helically around the tube with adjacent spirals of the fin being spaced apart.

Either prior to or after serration and before the fin is attached to the tube, the fin is enhanced by impressing, cutting, flattening, rolling or otherwise providing indentations therein, thus broadening the segments and increasing their surface area. The indentations can be of an endless variety of patterns and designs. The indentations are provided in either a top surface, a bottom surface, or both top and bottom surfaces of the segments. Also, indentations may be provided in a base portion, i.e. an unserrated proximal portion of the fin.

DETAILED DESCRIPTION OF THE PREFERRED EMBODIMENTS

Figure 2:
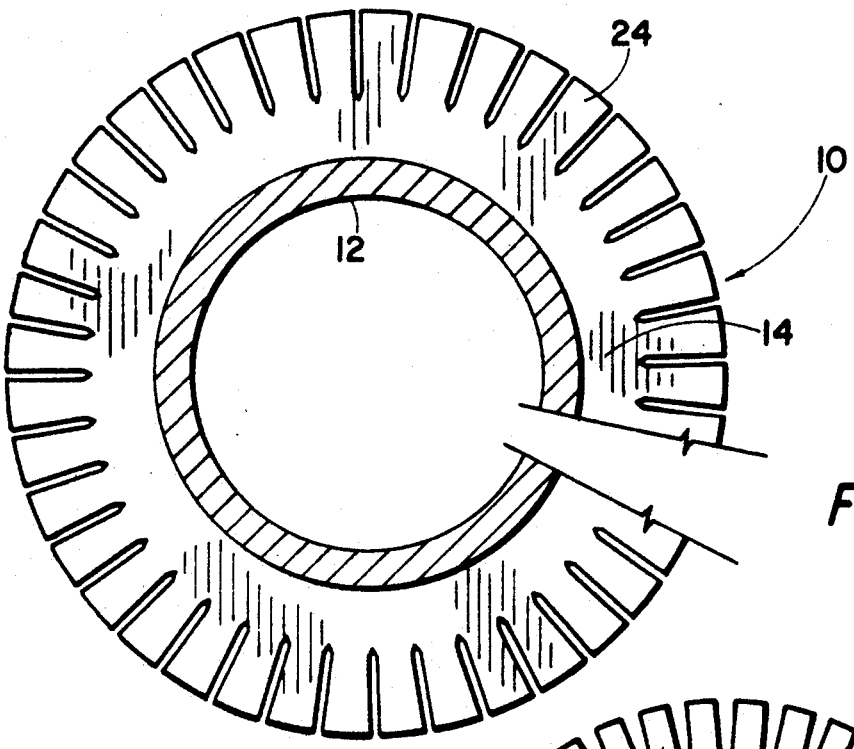
FIG. 2 is a cross-sectional view taken along line 2—2 of FIG. 1.
Figure 3:
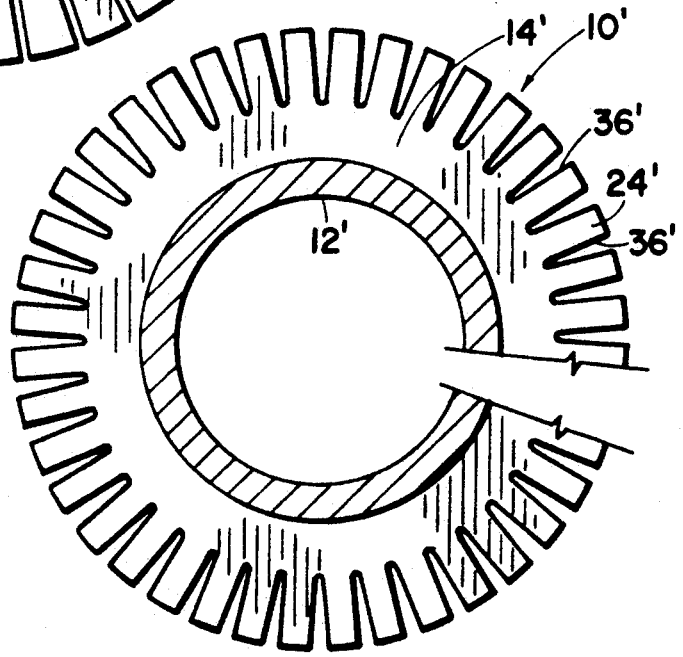
Fig. 3 (PRIOR ART)
FIG. 3 is a cross-sectional view of a prior art serrated finned tube, similar to the view of the enhanced serrated finned tube shown in FIG. 2.
Figure 1:
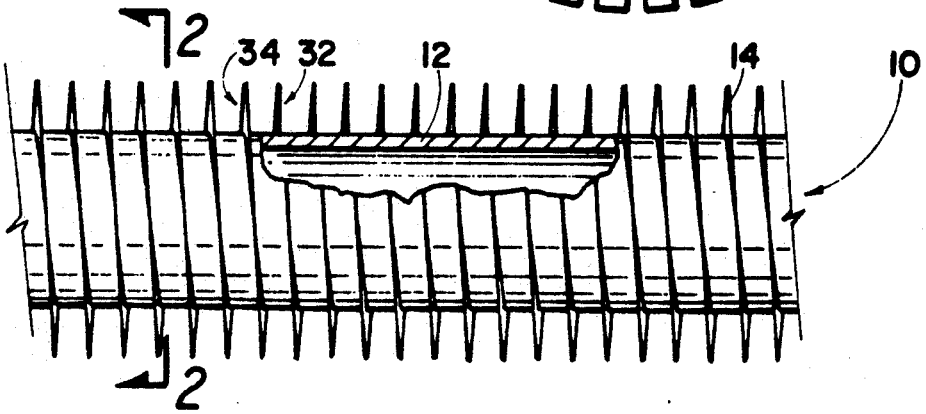
FIG. 1 is a side view of an enhanced serrated finned tube constructed according to a preferred embodiment of the present invention.

Referring now to the drawings and initially to FIGS. 1 and 2, there is illustrated an enhanced serrated finned tube, generally designated by the reference numeral 10, constructed according to a preferred embodiment of the present invention. The enhanced serrated finned tube 10 is provided with a central hollow tube 12 with a fin 14 attached thereto, usually attached by welding and preferably by high frequency resistance welding. The fin 14 extends outward from and is within 15 degrees of perpendicular with the tube 12. The fin 14 is also wrapped helically around the tube 12 with adjacent spirals of the fin 14 spaced apart from each other. The fin 14 may be constructed of carbon steel, nickel alloys or other suitable material.

Figure 4:
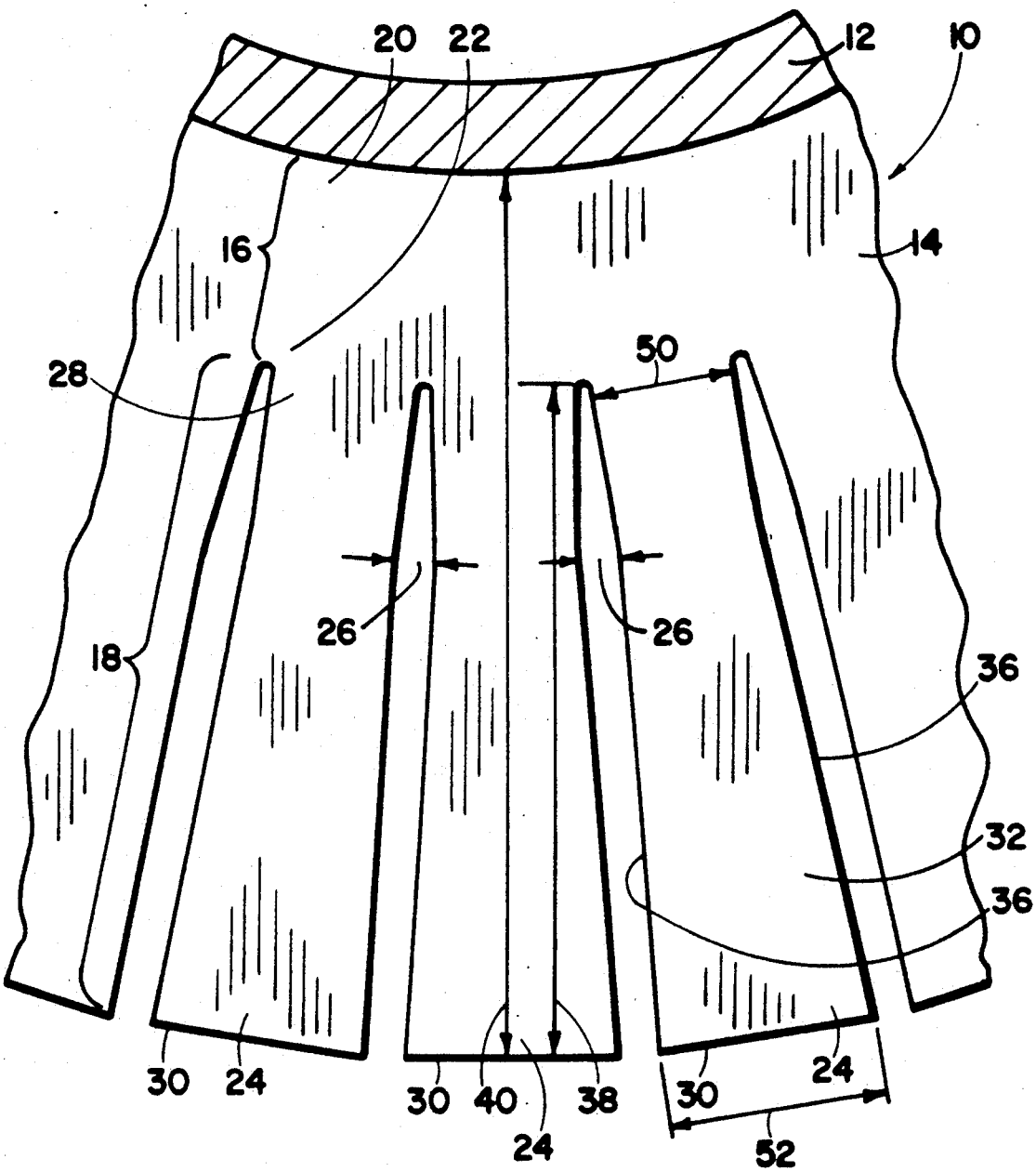
FIG. 4 is an enlarged partial view of the enhanced serrated finned tube shown in FIG. 2.

Referring now to FIG. 4, the fin 14 has a base portion 16 located adjacent to the tube 12 and a serrated portion 18 located adjacent to the base portion 16 and extending away from the tube 12. The base portion 16 is provided with a proximal edge 20 and an opposite distal area 22. The proximal edge 20 attaches to the tube 12 to secure the fin 14 thereto. The serrated portion 18 is provided with a multiplicity of segments 24, with adjacent segments 24 separated by gaps 26. Each segment 24 is provided with a proximal area 28 which is attached to the distal area 22 of the base portion 16, and with a distal tip 30 located opposite the proximal area 28. As shown in FIGS. 1 and 4, each segment 24 has a top surface 32 and a bottom surface 34 (see FIGS. 1, 9, 13) opposite the top surface 32, and two sides 36 located adjacent to the gaps 26 and on either side of the top and bottom surfaces 32 and 34.

Each segment 24 has a segment height 38 measured on the segment 24 from the proximal area 28 to the distal tip 30. Likewise, the fin 14 has a fin height 40 measured from the proximal edge 20 of the base portion 16 to the distal tip 30 of the segments 24.

Figure 9:
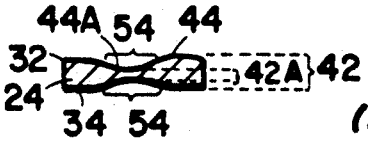
FIG. 9 is a cross-sectional view taken along line 9—9 of FIG. 8.

As illustrated in FIG. 9, each segment 24 has at least one segment depth 42; each segment depth 42 is measured from a point 44 on the top surface 32 of the segment 24, through the segment 24, i.e. from the top surface 32 to the bottom surface 34, perpendicularly to the segment height 38.

Obviously, if the top surface 32 and the bottom surface 34 are not parallel with each other, the segment depth 42 can vary depending upon which point 44 was selected for measuring the segment depth 42. As will become apparent, certain embodiments of the enhanced serrated finned tube 10 have segments 24 with top surfaces 32 and bottom surfaces 34 which are not parallel.

Figure 5:
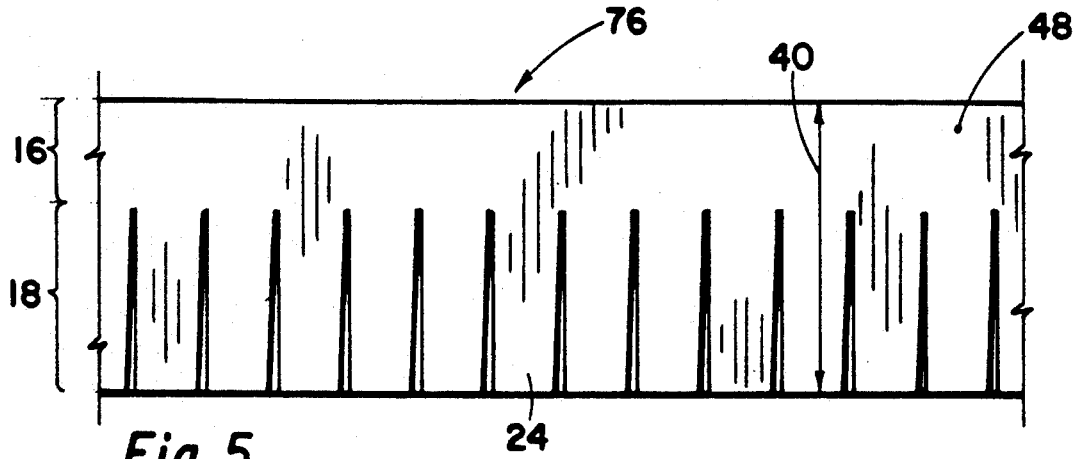
FIG. 5 is a top plan view of a serrated fin strip as it appears prior to being enhanced.
Figure 6:
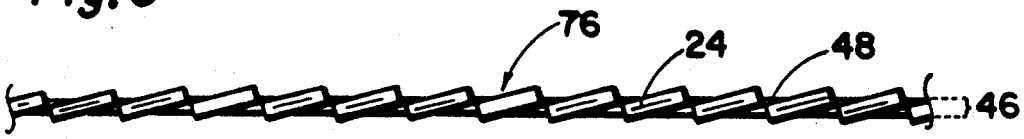
FIG. 6 is a front elevation of the serrated fin strip shown in FIG. 5.

Referring now to FIGS. 5 and 6, the base portion 16 has at least one base portion depth 46; each base portion depth 46 is measured from a spot 48 on the base portion 16, through the base portion 16 perpendicularly to the fin height 40.

Referring now to FIG. 4, each segment 24 also has a proximal width 50 measured between the two sides 36 at the proximal area 28 of the segment 24 and a distal width 52 measured between the two sides 36 at the distal tip 30 of the segment 24.

Referring now to FIGS. 2, 3, 4, 8, 9, 10 and 11 differences are illustrated between the enhanced serrated finned tube 10 and a prior art serrated fin tube, generally designated by numeral 10'. Similar to the enhanced serrated finned tube 10, the prior art serrated finned tube 10' shown in FIGS. 3, 10 and 11 with all of the same features as previously described for the enhanced serrated finned tube 10; said features will be hereinafter referred to by designating the numeral of the same feature on the enhanced serrated finned tube 10, followed by a prime "'" symbol. For example, 12' is a central hollow tube provided on the prior art serrated finned tube 10' which corresponds with the central hollow tube 12 on the enhanced serrated finned tube 10.

Figure 10:
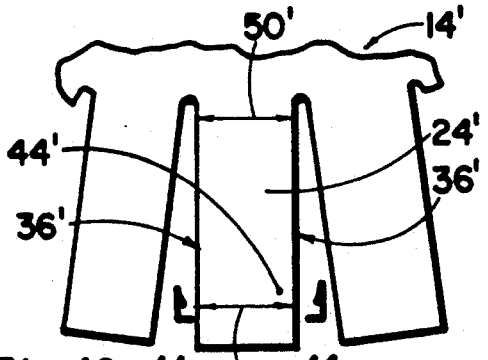
Fig. 10 (PRIOR ART)
FIG. 10 is an enlarged top plan view of a prior art segment.

First, the segments 24' of the prior art finned tube 10' have two sides 36' which are parallel with each other, and therefore, the segments 24' have distal widths 52' and proximal widths 50' which are equal to each other (see FIG. 10). This differs from the segments 24 of the enhanced serrated finned, tube 10 which has distal widths 52 greater than its proximal widths 50 (see FIG. 4). Widths 50 and 52 are not equal because the segments 24 have been enhanced and thus broadened. Thus, the segments 24' of FIG. 10 are rectangular in shape whereas the segments 24 of FIG. 4 are trapezoidal in shape.

Enhancing the segments 24 also produces a second difference in the enhanced serrated finned tube 10 with respect to the prior art serrated finned tube 10'. The second difference relates to the top and bottom surfaces 32 and 34 of the enhanced serrated finned 10 as compared to the top and bottom surfaces 32' and 34' of the prior art serrated finned tube 10'.

Figure 11:
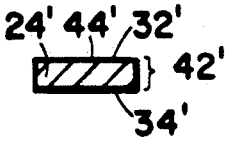
Fig. 11 (PRIOR ART)
FIG. 11 is a cross-sectional view taken along line 11—11 of FIG. 10.

Referring now to FIG. 11, there is shown a cross-sectional view through the segment 24' of the prior art fin 14'. The top and bottom surfaces 32' and 34' are parallel with each other and the segment depth 42' is the same regardless of which point 44' on the top surface 32' is chosen. However, as illustrated in FIG. 9, for example, the same is not true for the enhanced serrated fin 14 of the enhanced serrated finned tube 10. Depending on whether point 44 or an alternate point 44A on the top surface 32 is chosen, the segment depth 42 and an alternate segment depth 42A are not the same.

Figure 8:
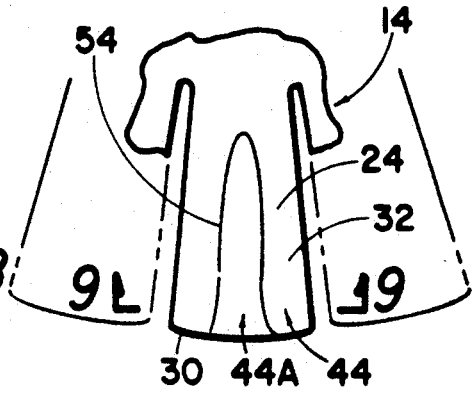
FIG. 8 is an enlarged top plan view of a single enhanced segment having a long tapered indentation.

The fin 14 of the enhanced serrated finned tube 10 shown in FIGS. 8 and 9 is provided with a long, tapered indentation 54 impressed into both the top and bottom surfaces 32 and 34. By enhancing the fin 14 with the indentation 54, the segments 24 are thus broadened and their surface area is increased. Many patterns and designs are possible as indentations 54. A few possible embodiments are illustrated and discussed below.

Figure 12:
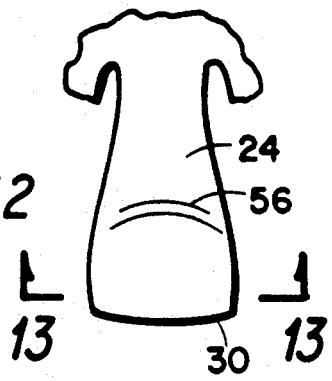
FIG. 12 is an enlarged top plan view of a single enhanced segment having a broad flat indentation.
Figure 13:
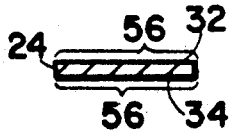
FIG. 13 is a cross-sectional view taken along line 13—13 of FIG. 12.

FIGS. 12 and 13 illustrate another embodiment wherein a broad flat indentation 56 is impressed into both the top and bottom surfaces 32 and 34 at the distal tip 30 of the segment 24.

Figure 14:
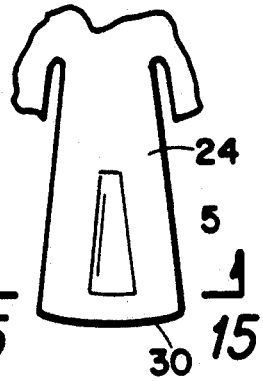
FIG. 14 is an enlarged top plan view of a single enhanced segment having a central triangular indentation.
Figure 15:
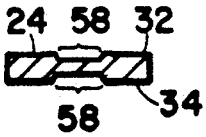
FIG. 15 is a cross-sectional view taken along line 15—15 of FIG. 14.

FIGS. 14 and 15 illustrate another embodiment wherein a central triangular indentation 58 is impressed into both the top and bottom surfaces 32 and 34.

Figure 16:
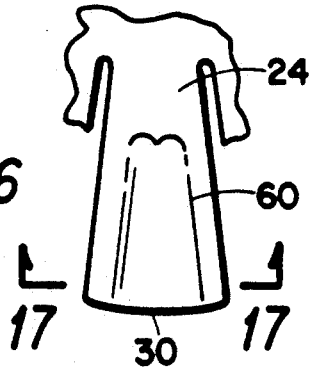
Figure 16 is an enlarged top plan view of a single enhanced segment having a long, double tapered indentation.
Figure 17:
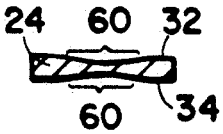
FIG. 17 is a cross-sectional view taken along line 17—17 of FIG. 16.

FIGS. 16 and 17 illustrate an additional embodiment wherein a long, double tapered indentation 60 is impressed into both the top and bottom surfaces 32 and 34.

Figure 18:
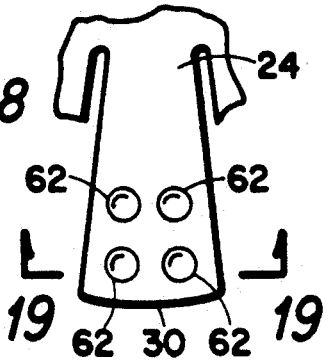
FIG. 18 is an enlarged top plan view of a single enhanced segment having dotted indentations.
Figure 19:
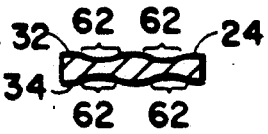
FIG. 19 is a cross-sectional view taken along line 19—19 of FIG. 18.
Figure 20:
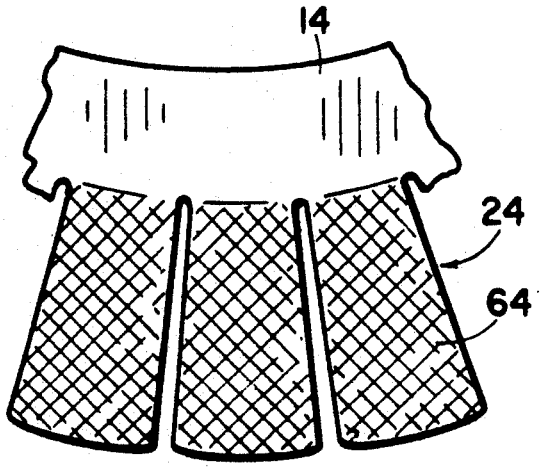
FIG. 20 is an enlarged top plan view of segments having a diamond pattern indentation impressed therein.
Figure 21:
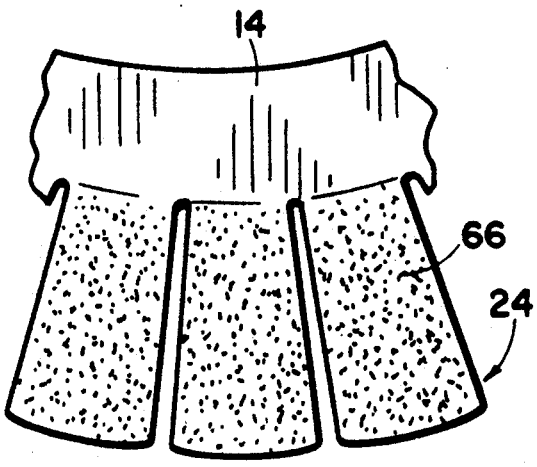
FIG. 21 is an enlarged top plan view of segments having a pin point pattern indentation impressed therein.
Figure 22:
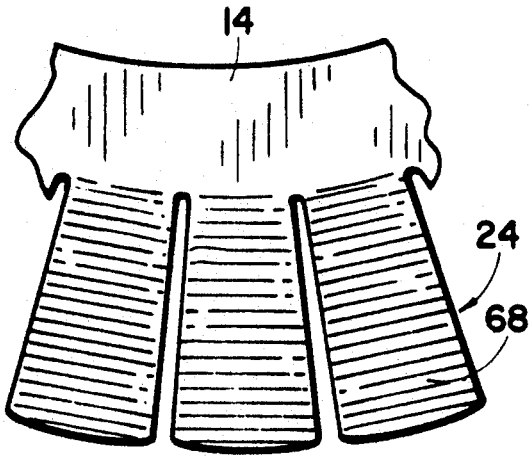
FIG. 22 is an enlarged top plan view of segments having a horizontal ribbed pattern indentation impressed therein.
Figure 23:
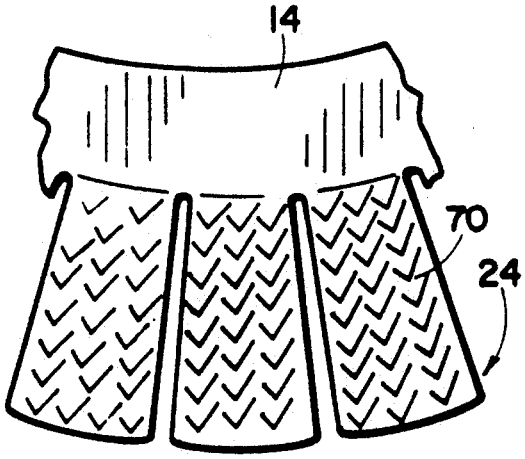
FIG. 23 is an enlarged top plan view of segments having a pitted pattern indentation impressed therein.
Figure 24:
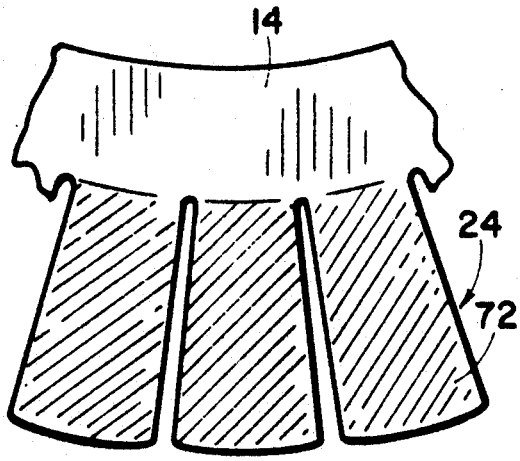
FIG. 24 is an enlarged top plan view of segments having a diagonal ribbed pattern indentation impressed therein.

FIGS. 18 and 19 illustrate another embodiment wherein dotted indentations 62 are impressed into both the top and bottom surfaces 32 and 34.

FIGS. 20, 21, 22, 23, and 24 illustrate still other embodiments wherein the top and bottom surfaces 32 and 34 are impressed, respectively, with diamond pattern indentations 64, pin point pattern indentations 66, horizontal ribbed pattern indentations 68, pitted pattern indentations 70, and diagonal ribbed pattern indentations 72.

Figure 25:
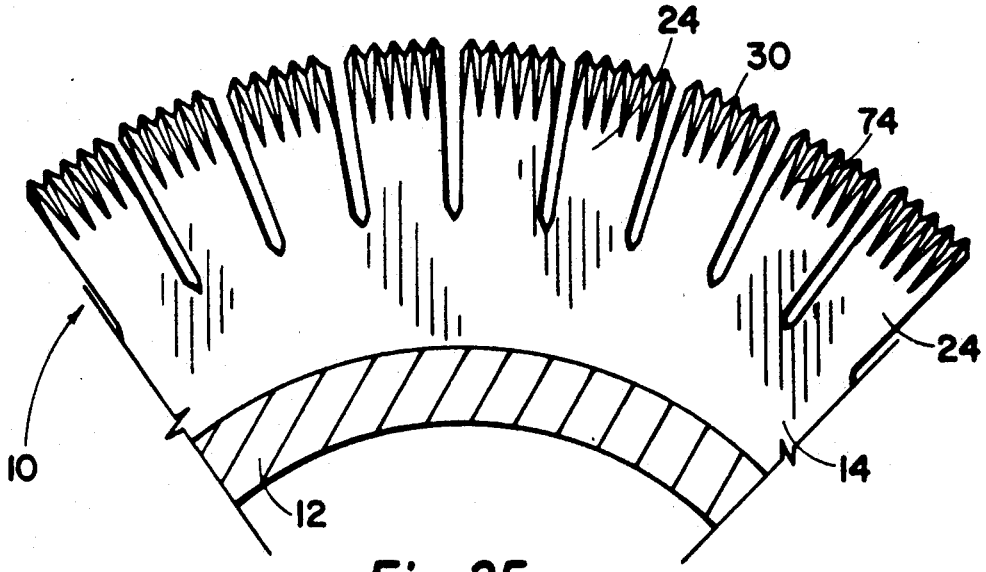
FIG. 25 is an enlarged top plan view of segments having jagged, grooved indentations provided at the distal tip of the fin.

Finally, FIG. 25 illustrates another embodiment wherein the distal tips 30 of the segments 24 are impressed with jagged, grooved indentations 74.

As an example of the amount of increase in surface area attainable by the present invention, the following percentages of surface area enhancement are attained utilizing a 2 inch tube 12, various fin heights 40, a base portion depth 46 of 18 gauge metal, a 0.172 inch proximal width 50, and various distal widths 52. The data listed below is attained for pie-shaped serrated fins 14 which are spaced five (5) fins 14 per inch of tube 12.

| Fin Height | Distal Width of Segments | Surface Area Increase (In Percentage) |
|---|---|---|
| 1 inch | 0.256 inches | 13.9 |
| ¾ inch | 0.237 inches | 10.2 |
| ½ inch | 0.218 inches | 6.7 |

Whereas several embodiments have been described above, the present invention is not limited to the specific embodiments disclosed. Although the enhanced serrated finned tube 10 has been described as having indentations impressed in both the top and bottom surfaces 32 and 34 of the segments 24, the present invention encompasses embodiments wherein either the top surface 32 or the bottom surface 34 is enhanced, as well as embodiments wherein both the top and bottom surfaces 32 and 34 are enhanced.

Figure 7:
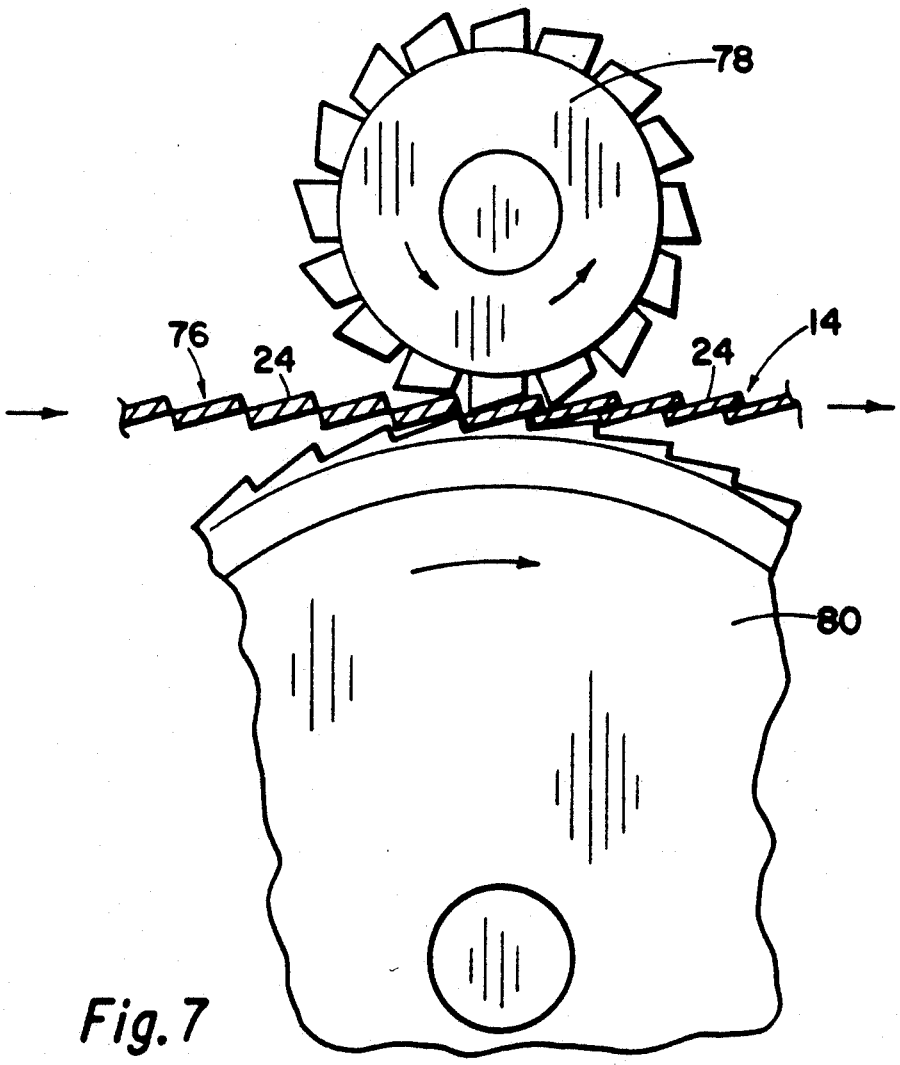
FIG. 7 is a front elevation of the serrated fin strip shown in FIG. 6 illustrating a method for enhancing the serrated fin strip.

Referring now to FIGS. 5, 6 and 7 there is illustrated one method for producing the fin 14, i.e. enhancing after serrating and prior to the fin 14 being attached to the tube 12. FIGS. 5 and 6 illustrate a straight piece of unenhanced serrated fin strip 76. Prior to enhancement, the base portion depth 46 and the segment depths 42 are all equal to each other. FIG. 7 shows how the unenhanced serrated fin strip 76 passes between enhancing tools 78 and 80 and emerges as enhanced serrated fin 14 which is ready to be attached to the tube 12 to form the enhanced serrated finned tube 10. If the base portion 16 is not enhanced, the base portion depth 46 will remain unaltered after enhancement. If the segments 24 are enhanced, their segment depths 42 and 42A will differ from the base portion depth 46 and possibly differ from each other, depending on which points 44 or 44A are selected.

Figure 26:
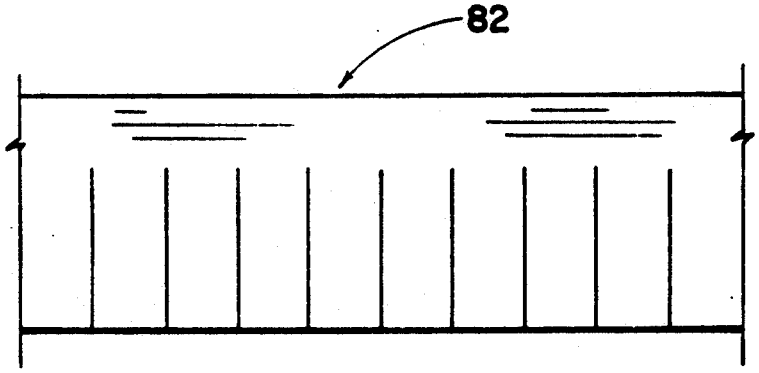
FIG. 26 is a top plan view of a unserrated enhanced fin strip wit undulations impressed therein.
Figure 27:
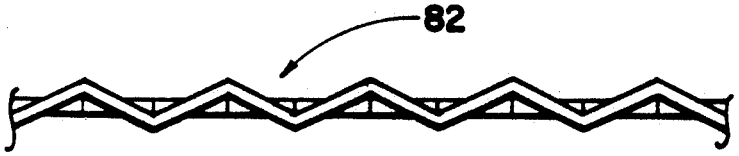
FIG. 27 is a front elevation of the unserrated enhanced fin strip illustrated in FIG. 26.
Figure 28:
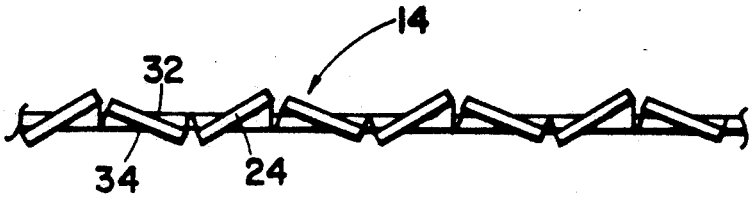
FIG. 28 is a front elevation of the unserrated enhanced fin strip of FIG. 27 as it appears after being serrated.

Alternately, another method for producing the fin 14, i.e. enhancing prior to serrating, is illustrated in FIGS. 26, 27 and 28. FIGS. 26 and 27 show a straight piece of unserrated enhanced fin strip 82. FIG. 28 shows the same strip 82 after being serrated to form enhanced serrated fin 14 which is ready to be attached to the tube 12 to form the enhanced serrated finned tube 10.

Whereas two methods have been described above for producing the fin 14, the present invention is not limited as to the method of its production.

Whereas, the present invention has been disclosed in terms of the specific structure described above, it should be understood that other and further modifications, apart from those shown or suggested herein, may be made within the spirit and scope of this invention.

What is claimed is:

1. A finned tube comprising a tube and an enhanced serrated fin attached thereto, the fin having a base portion and an opposite serrated portion, the base portion being provided with a proximal edge and an opposite distal area, said proximal edge being helically to the tube so the fin extends outward from the tube, said distal area being attached to the serrated portion, the serrated portion being provided with a plurality of segments extending around the periphery of the tube, adjacent segments being separated by gaps, each segment being provided with a proximal area which is attached to the distal area of the base portion and a distal tip located opposite its proximal area, each segment having a proximal width measured at the proximal area, each segment having a distal width measured at the distal tip of the segment, each segment being enhanced in such a way that each segment is broadened whereby the distal width of each segment is greater than the proximal width of each segment thus resulting in pie-shaped segments.

2. A finned tube according to claim 1 wherein each segment is broadened by passing the serrated fin strip between enhancing tools prior to attachment of the fin to the tube.

3. A finned tube according to claim 1 wherein each segment has a top surface and an opposite bottom surface, at least one surface being provided with indentations which broaden said segments and increase their surface area.

4. A finned tube according to claim 3 wherein said indentations are provided by long tapered indentations impressed into the top and bottom surfaces of each segment.

5. A finned tube according to claim 3 wherein said indentions are provided by broad flat indentations impressed into the top and bottom surfaces of each segment at the distal tip thereof.

6. A finned tube according to claim 3 wherein a central triangular indentation is impressed into both top and bottom surfaces of each segment.

7. A finned tube according to claim 3 wherein a long double tapered indentation is impressed into both the top and bottom surfaces of each segment.

8. A finned tube according to claim 3 wherein dotted indentations are impressed into at least one surface of each segment.

9. A finned tube according to claim 3 wherein a diamond shaped pattern indentation is impressed into at least one surface of each segment.

10. A finned tube according to claim 3, wherein a pinpoint pattern indentation is impressed into at least one surface of each segment.

11. A finned tube according to claim 3 wherein a horizontal ribbed pattern indentation is impressed into at least one surface of each segment.

12. A finned tube according to claim 3 wherein a pitted pattern indentation is impressed into at least one surface of each segment.

13. A finned tube according to claim 3 wherein a diagonal ribbed pattern indentation is impressed into at least one surface of each segment.

14. A finned tube according to claim 3 wherein the distal tips of the segments are impressed with jagged grooved indentations.

* * * * *